US005377876A

United States Patent [19]

Smernoff

[11] Patent Number: 5,377,876

[45] Date of Patent: Jan. 3, 1995

[54] DISPOSABLE CONTAINER FOR POURABLE MATERIALS HAVING AN INTERLOCKING SPOUT

[76] Inventor: Ronald Smernoff, 118 Starlite St., South San Francisco, Calif. 94080-6310

[21] Appl. No.: 48,018

[22] Filed: Apr. 14, 1993

[51] Int. Cl.[6] ..... B65D 35/56

[52] U.S. Cl. ..... 222/105; 222/183

[58] Field of Search ..... 222/105, 153, 183, 185; 220/465; 229/117.16

[56] References Cited

U.S. PATENT DOCUMENTS

| | | | |
|---|---|---|---|
| 3,108,732 | 10/1963 | Curie et al. | 222/105 |
| 3,124,282 | 3/1964 | Winstead | 222/569 |
| 3,223,117 | 12/1965 | Curie et al. | 222/183 |
| 3,234,594 | 2/1966 | Winstead | 156/501 |
| 3,235,638 | 2/1966 | Winstead | 264/545 |
| 3,363,807 | 1/1968 | Powell | 222/105 |
| 3,727,824 | 4/1973 | Giebel et al. | 229/117.16 |
| 4,322,018 | 3/1982 | Rutter | 222/105 |
| 4,355,737 | 10/1982 | Pongrass et al. | 222/105 |
| 4,375,864 | 3/1983 | Savage | 222/105 |
| 4,660,737 | 4/1987 | Green et al. | 222/105 |
| 4,793,519 | 12/1988 | Voorhies | 220/465 |
| 4,815,631 | 3/1989 | Eeg et al. | 222/183 |
| 4,850,506 | 7/1989 | Heaps, Jr. et al. | 220/403 |
| 4,863,052 | 9/1989 | Lambert | 229/117.4 |
| 4,978,028 | 12/1990 | George et al. | 220/403 |
| 4,996,760 | 3/1991 | Coleman | 222/105 |
| 5,031,792 | 7/1991 | Russo, Sr. | 220/403 |
| 5,042,682 | 8/1991 | Ritter et al. | 222/185 |
| 5,048,691 | 9/1991 | Heuberger et al. | 220/403 |
| 5,050,775 | 9/1991 | Marquardt | 222/93 |
| 5,111,970 | 5/1992 | Rutter et al. | 222/105 |
| 5,163,485 | 11/1992 | Hermann | 222/183 |

*Primary Examiner*—Andres Kashnikow
*Assistant Examiner*—Philippe Derakshani
*Attorney, Agent, or Firm*—Fulwider Patton Lee & Utecht

[57] ABSTRACT

An improved bladder within in a box container having a locking flap in the outer container configured to more reliably interlock the spout and the outer container during dispensing of the contents. The outer container is configured to be conveniently broken down flat for recycling or disposal.

23 Claims, 6 Drawing Sheets

DISPOSABLE CONTAINER FOR POURABLE MATERIALS HAVING AN INTERLOCKING SPOUT

BACKGROUND OF THE INVENTION

1. Field of the Invention

This invention relates to containers for storage, transport and dispensing of fluids. More particularly, the invention relates to an improved configuration of such a container wherein a flexible fluid-tight bladder is enclosed within a cardboard or other suitably rigid container, the bladder including a dispensing means, such as a resealable opening or spout, which can be accessed through the outer container.

2. Description of Related Art

Containers of the type combining a fluid-tight bladder within a rigid or semi-rigid outer container can be useful in numerous applications, for example, easy and economical storage and transport of liquids and other pourable materials, particularly if the containers must be stacked or handled. As an alternative to bulk storage such containers may be stacked in a storage facility and brought individually to a more convenient site, as need arises, and used there for dispensing the contents over a period of time.

The ease of recycling containers of this type is one of their distinct advantages. The inner bladder, usually made of flexible plastic, can be removed and collapsed. The outer container, usually of corrugated or stiff paperboard construction, is broken down to become relatively flat and stackable. This separation and compaction of both components allows them to be easily recycled.

Cost advantages can be realized in using cardboard or other relatively inexpensive materials for the container, combined with a relatively thin bladder. In certain applications, a single removable spout or other pouring means can De used with multiple containers, providing further cost savings.

Even if such a container is not recycled, it is often superior to other types of containers for liquids and other pourable materials from an environmental standpoint in that the outer container of cardboard or other sufficiently rigid paperboard can be made of biodegradable material. Also, the inner bladder requires the use of much less plastic material than a container made solely from plastic, since no structural rigidity is required of the bladder. For these and other reasons it has been recognized that containers of this type have distinct advantages for the dispensing of fluids in a variety of circumstances, from drinking fluids such as wine or water to laboratory chemicals. However, a number of drawbacks and limitations exist in prior art containers.

In order to facilitate stacking, and the handling of the container during transport, the spout or other dispensing means is usually completely contained within the outer box container. The spout is accessed by opening the box, or is exposed by removal of a die-cut punch-out or the like in one surface of the box. As the contents are dispensed over time, the bladder collapses and the spout or other dispensing means retreats into the box. This is inconvenient, since the spout must be pulled out for each use, and also the contents of the bladder may drip onto or inside the box, causing deterioration and eventual failure of the outer container.

Although recycling potential is one of the advantages of this type of container, many prior art containers are difficult to break down. Some prior art container designs for example employ RSC (regular slotted container) closures which are difficult to break down because they involve a mechanical interlock of tabs and slots in the corners of the box which are difficult to access to disengage. Thus, any attempt to flatten the box for storage or transport in a recycling process is made more difficult. Other prior art containers employ adhesive closure on many faces. Adhesive fastened containers are also difficult to break down for disposal or storage, and tend to tear and ball up in this process, thereby occupying more space instead of lying flat.

Other prior art containers have means to secure the spout in a wall of the box during the time when the contents of the container are being consumed. This has been done by providing a die-cut slot and flap arrangement into which the spout is placed. After breaking the die-cut perforations defining the slot and flap, thereby accessing the spout, it is pulled out and into position in the slot. The flap or flaps are then re-closed to retain the spout in position. However, the act of breaking the perforations causes weakening of the flap or flaps, and the spout is often not reliably retained in place. For example, in many prior art containers, opening the cutout causes folds to be formed in the flap material, along failure lines parallel to the scored hinge in the material. This allows the flap to roll up or be displaced upward in the direction the flap is opened, perpendicular to the hinge line, allowing the flap to move away from the spout and the spout to become disengaged from the box wall. This problem can be exacerbated when corrugated cardboard is used to form the outer container, since the corrugations of the cardboard container give little resistance to bending along lines of failure parallel to the corrugations. In prior art containers this problem can allow the spout to slip from its proper position in the outer container.

If the spout is not reliably retained in the box wall, the use of the container can be very inconvenient, particularly if the level of fluid is low in the bladder and it is thus predisposed to withdraw into the outer container box.

Those concerned with the development and use of containers of this type have long recognized the need for an improved container that retains the inherent advantages of the configuration, while reducing the problems with prior art containers discussed above. The present invention fulfills these needs.

SUMMARY OF THE INVENTION

Briefly, and in general terms, the present invention provides an improved disposable container for pourable materials of the type having a flexible inner bladder and a rigid or semi-rigid outer container. The invention provides a container construction in which a resealable spout in the bladder is firmly interlocked with the outer container by providing a locking flap which opens in a direction perpendicular to a slot in which the spout is received. The locking flap, when closed, retains the spout in the slot, thereby making dispensing the contents of the container more convenient. Furthermore, the spout and the locking flap may interact to hold the locking flap in a closed position, as the locking flap holds the spout in the slot. This mutual cooperation is accomplished by providing the interlocking portion of the spout opening with two outwardly protruding parallel flanges which engage the outer container on the inner and outer surfaces. When the locking flap is closed, the spout is moved toward the locking flap so that the flanges incorporated in the spout engage the locking flap as well as the container wall adjacent the slot, locking the flap in closed position.

When corrugated cardboard is used to form the outer container, the corrugations are aligned with the slot so that the direction in which the corrugated cardboard most resists bending coincides with the direction in which the spout will travel in slipping out of the slot. Thus the locking flap is most resistent to bending in precisely the direction in which the spout is most likely to push against it.

The slot in which the spout is received is located in a relatively stiff area of the outer container wall adjacent the edge folds. Preferably the slot is located in a corner of a side wall surface of the outer container, thereby acquiring further rigidity by the proximity of two non-collinear edge-folds.

Additionally, the outer container can be con-figured to be folded into a box shape and then closed with a single length of adhesive tape. This construction makes breaking down the container for recycling comparatively easy, as the tape can be broken, cut, or pulled off with ease, and the box simply unfolded to a flat condition for convenient stacking. The inner bladder may then be separated from the outer container for separate recycling or disposal, and being relatively thin, is also easily flattened or otherwise compressed.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
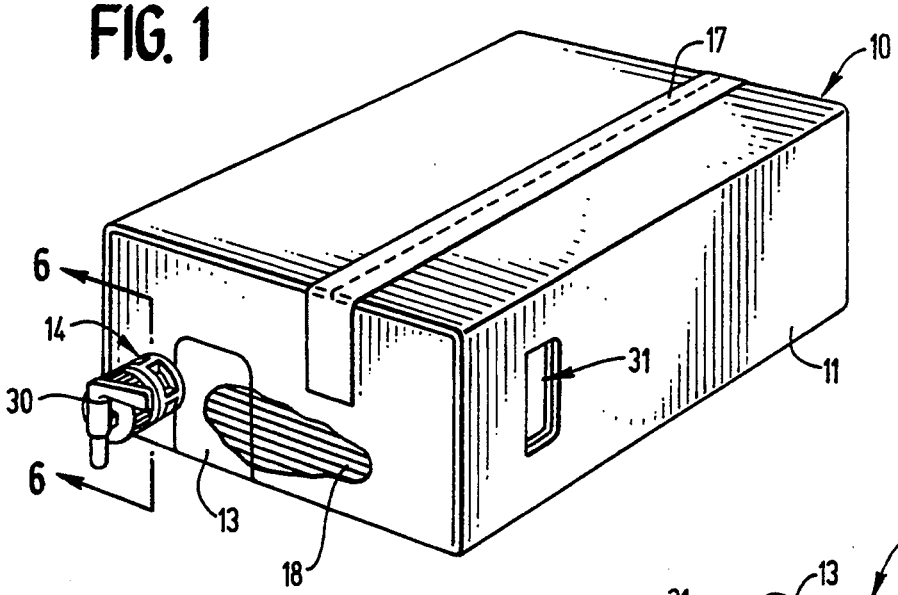
FIG. 1 is a perspective view of a container according to the invention configured for dispensing.

As shown in the drawings, which are provided for purposes; of illustration and not by way of limitation, the invention is embodied in a disposable container 10 for pourable materials of the type having an outer container 11 for maintaining the shape of the container 10 and protecting its contents, and an inner liner or bladder 12 which is fluid-tight to contain pourable materials, especially fluids. The outer container 11 allows stacking and handling of the container and provides a rigid dispenser at the point of use.

Figure 3:
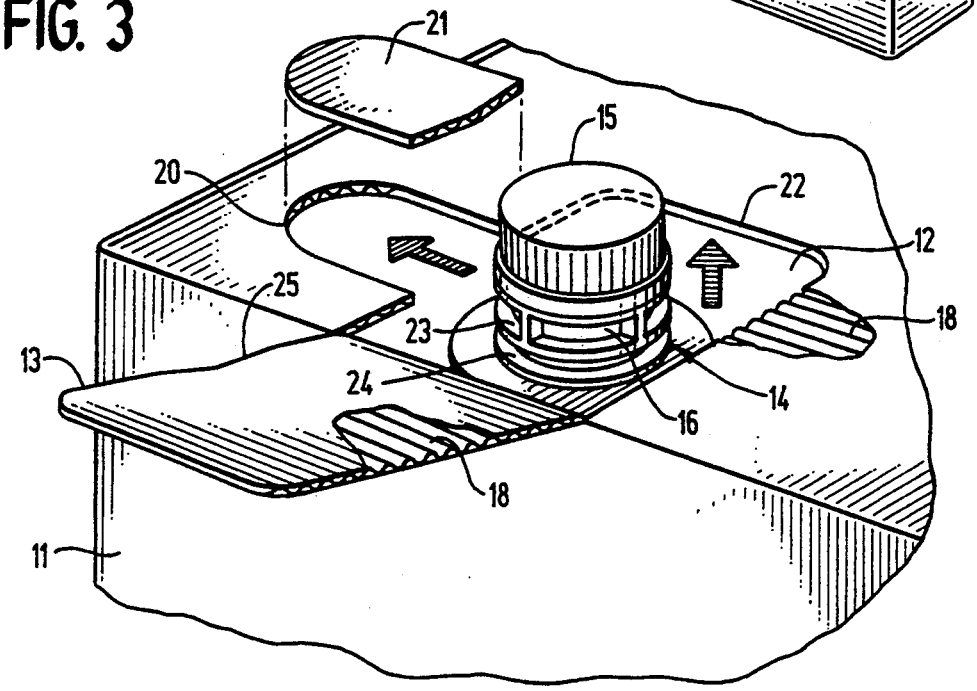
FIGS. 3 is an exploded perspective view of a spout interlocking portion of a container according to the invention, illustrating conversion to a dispensing configuration.

Referring to FIGS. 1 & 3, in accordance with the present invention, a slotted portion 20 in the outer container 11 is provided having an elongated dimension wherein a spout 14 of the inner bladder 12 is received. A locking flap 13, which opens and closes in a direction perpendicular to the elongated direction of the slot 20, is used to reliably lock the spout 14 in place, significantly improving the convenience of the disposable container 10 in use. Additionally, the outer container 11 is closed by a single length of adhesive tape 17, which makes breaking down the container for recycling or disposal more convenient. According to FIG. 1, this particular example of the container 10 is configured for dispensing its contents on a rigid surface (not shown) such as a shelf to make access to a spout 14 comprising a resealable closure of the inner lining 12 more convenient.

Figure 2:
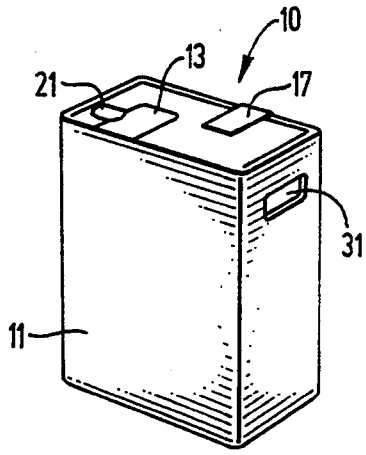
FIG. 2 is a perspective view of a container according to the invention configured for shipment.

As shown in FIGS. 2 & 3, the inner bladder 12, which is preferably formed of plastic and is disposed entirely within the outer container 11 during shipment, is accessed by means of a die-cut locking flap 13 which opens to reveal a spout 14 comprising a resealable opening in the inner bladder 12. The spout 14 is made resealable by means of a 38/400 screw-cap closure 15. The spout has a griping portion 16 of ribbed indentations to make grasping the spout 14 more convenient.

A slotted portion 20 of the outer container 11 is formed by removal of a die cut tab 21. The slot 20 thus formed is interconnected to an access opening 22 formed by opening the locking flap 13. A user can then reach into the access opening 22 and grasp the spout 14 and pull it out through the access opening, and then slide the spout 14 into the slot 20 in the outer container. The spout is adapted to interlock with the outer container 11 by means of an outer annular flange 23 and an inner annular flange 24 which extend transversely from the spout 14 beyond the sides of the slot 20, and inter-fit with the wall of the outer container 11 to prevent the spout from slipping farther out of the outer container or slipping back inside.

Figure 4:
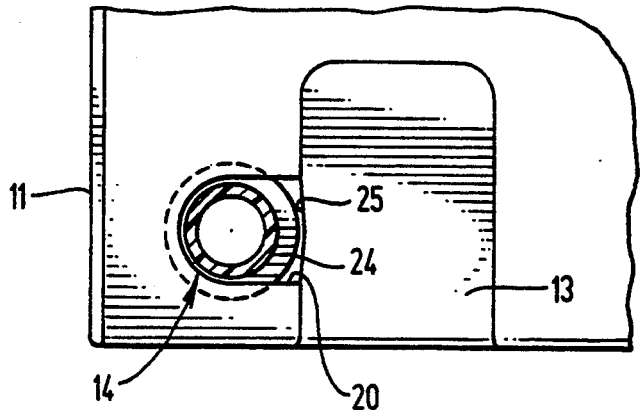
FIG. 4 is a side elevational view, partially in section, of the spout interlocking portion of such a container.
Figure 5:
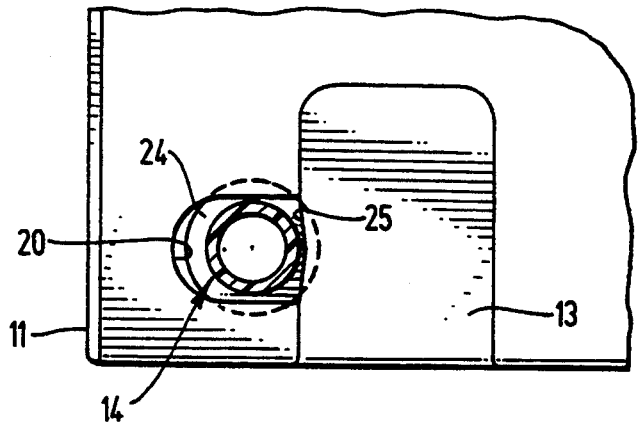
FIG. 5 is a side elevational view, partially in section, of the spout interlocking portion of such a container.

The locking flap 13 is then closed and the spout 14 is subsequently moved toward the locking flap so that the flanges 23 and 24 engage the locking flap as well as the wall of the outer container 11. This is shown in FIGS. 4 and 5. A cut-out portion 25 on the locking flap coincides with the location of the slot 20 to provide clearance between the locking flap 14 and the outer flange 23 in closing the locking flap. This cut out portion 25 also allows the flanges 23 and 24 to engage more of the locking flap 14 when the spout is moved back against the locking flap. Engagement of the locking flap 14 and the wall of the outer container 11 on either side of the slot 20 holds the locking flap 14 in closed position. This arrangement interlocks the spout with the outer container 11 so that it will remain fixed in place while the contents of the container 10 are dispensed.

Figure 6:
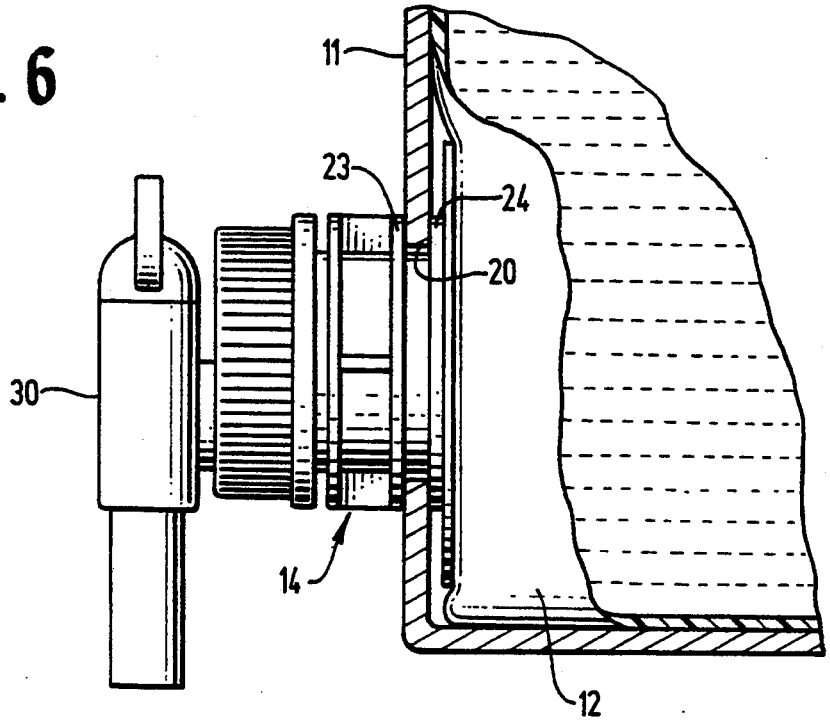
FIG. 6 is a sectional view of the spout portion of the container according to the invention taken along lines 6—6 in FIG. 1.

The interlock of the spout 14 and the outer container 11 is further illustrated by FIG. 6. After the spout is interlocked with the outer container 11 a screw-on spigot 30 for convenient dispensing can replace the screw-cap 15. Thereafter the container 10 can be placed in a convenient orientation for dispensing. Of course, other types of resealable dispensing closures might be employed instead of the screw-cap or spigot shown in the drawings and are contemplated within the scope of the invention.

Corrugated cardboard is preferably used to form the outer container 11 and the properties of this material are exploited to advantage in the construction of the invention. The outer container is configured so that the corrugations 18 of the cardboard are aligned with the direction in which the spout is inserted into the slotted portion 20. The cardboard having greater rigidity against bending in the direction aligned with the corrugations 18, and less rigidity in resisting bending in the direction perpendicular to the corrugations 18, the locking flap 13 thus develops a greater resistance to bending in the direction in which force may be applied by the spout. The locking flap opens in the direction in which there is little resistance to bending, thereby advantageously forming a hinge line along the one edge of the locking flap 13 which is not die cut. In the illustrated embodiment, the hinge of the locking flap 13 coincides with an edge-fold of the outer container box 11, so that the material is predisposed to form a hinge line for the locking flap 13 at that location.

Figure 7:
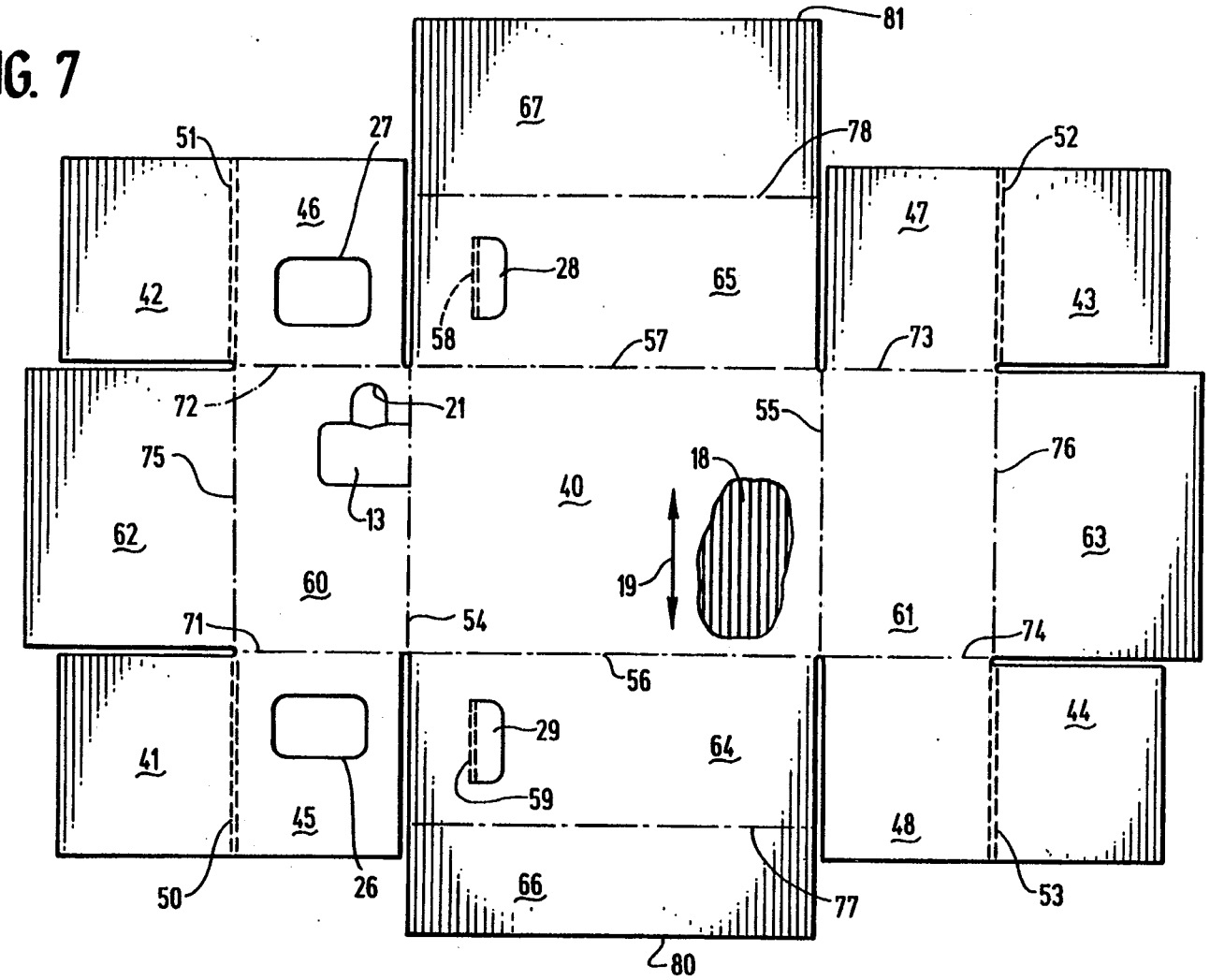
FIG. 7 is a plan view of an outer container according to the invention before folding.

The sheet of corrugated cardboard comprising the outer container 11 is scored for folding in a conventional manner. The lay-out for the particular box shape of the container 10 described and illustrated herein is shown in FIG. 7. However, those skilled in the art will recognize that modifications can be made to alter the shape of the assembled container without departing from the invention. Those skilled in the art will also recognize that while the container is shown to be preferably constructed of cardboard, other materials which are lightweight and relatively rigid, such as composites and low density plastic structural panels may be used.

As illustrated in FIG. 7, the outer container 11 is advantageously formed of a single sheet of corrugated cardboard, with the die-cut portions previously described incorporated therein. Particularly, the alignment 19 of the corrugations 18 matches the elongated direction of the slot tab 21 defining the slot 20 wherein the spout 14 is received. Additionally, handle cut-outs 26 and 27, and handle portions 28 and 29 with double score lines 58 and 59 for forming a handle portions 31 in the walls of the outer container 11 are incorporated in the cardboard. Preferably the handle cut outs 31 are positioned on opposite sides of the outer container 11 when it is in an assembled state.

Figure 8:
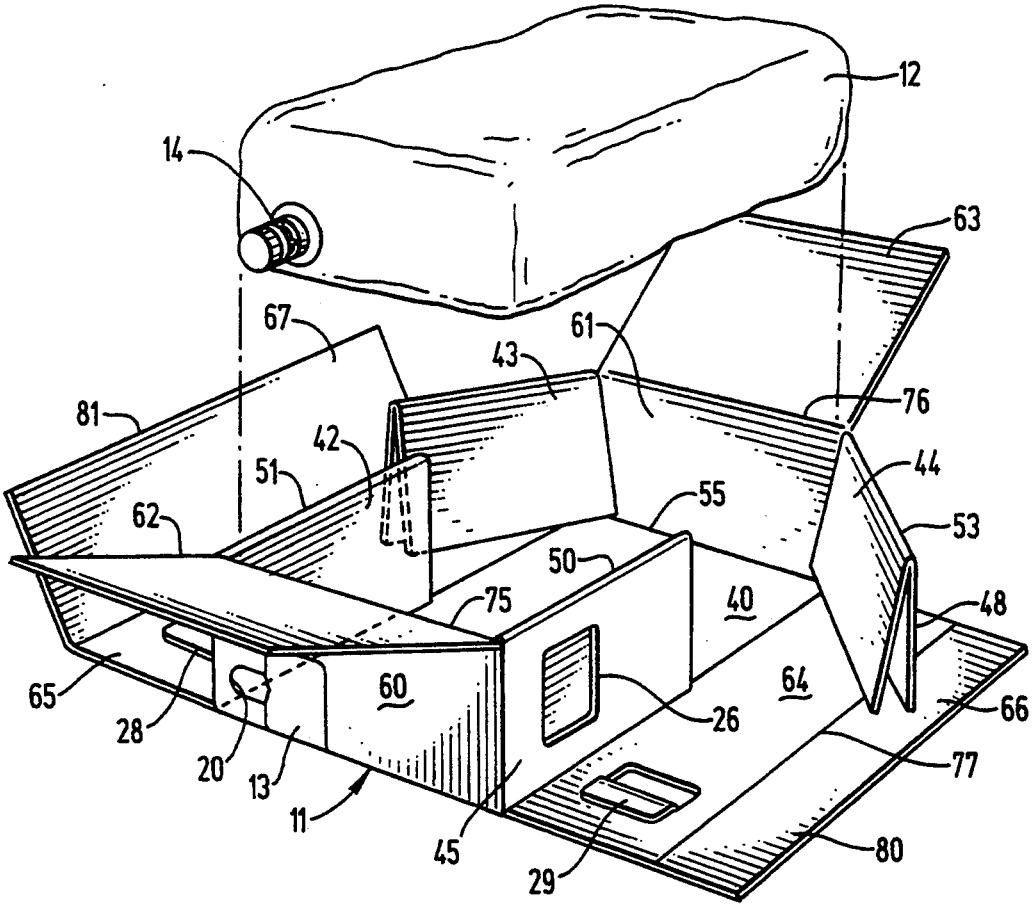
FIG. 8 is an exploded perspective view of a container according to the invention illustrating folding and assembly.

As illustrated in FIG. 8, the container 10 is assembled by folding the sheet of cardboard comprising the outer container 11 and inserting the inner lining 12. Referring to both FIGS. 7 and 8, tabs 41, 42, 43, and 44 are folded over onto tabs 45, 46, 47, and 48 respectively, along double score lines 50, 51, 52, and 53. These tabs may be glued together if desired, as this fold is to double the thickness of tabs 45, 46, 47, and 48 only, and will not prevent the outer container 11 from subsequently being unfolded into a flat condition, save only the doubling of thickness in those areas. Gluing tabs 41, 42, 43, and 44 to tabs 45, 46, 47, and 48 provides additional stiffness to the outer container.

Next in the sequence of assembly, walls 60 and 61 are folded up from bottom 40 about edge-folds 54 and 55; and tabs 45, 46, 47, and 48 are folded inwardly about edge-folds 71, 72, 73, and 74 respectively to line up with edge-folds 56 and 57. Walls 64 and 65 are then folded up from bottom 40 about edge-folds 56 and 57 respectively. At this point inner liner 12 is placed within the outer container 11. Thereafter tabs 62 and 63 are folded over the inner liner 12 about edge-folds 75 and 76 to form an inner layer of the top of the outer container 11. Lastly, outer wall tabs 66 and 67 are folded inwardly over tabs 62 and 63, about edge-folds 77 and 78 respectively, to form the top of the outer container.

The outer container is then closed by a single length of adhesive tape 17 which is applied between walls 60 and 61 across a joint formed by joined edges 80 and 81 of wall tabs 66 and 67 respectively. This holds wall tabs 66 and 67 together to form a top wall of the outer container 11. This adhesive tape closure is conventional and is further shown in FIG. 1.

The adhesive tape 17 can be removed, and the outer container box 11 unfolded and flattened relatively easily compared with prior art containers employing other closure means such as RSC closures or adhesively joined tabs. This is a distinct advantage in recycling or disposal.

Returning to FIGS. 7 and 8, in the area of the handle cut out 31 on either side of the assembled outer container 11, the container is 3 layers thick. This allows a handle cut-out 31 to be made in two layers, providing sufficient grip, while leaving a third layer to protect the inner liner 12 from punctures etc.

Furthermore, it is preferable to place the handles 31 in opposite side walls 64 and 65 of relatively narrower dimension, compared with walls formed by wall portion 40 or 66 combined with 67. This places the handles in an area of the container stiffened by the relatively closer proximity of edgefolds.

The handle cut-outs 26 and 27 are configured to abuttingly receive the handle portions 28 and 29 when they are folded inwardly and then upwardly to form handles 31 in the outer container. Tabs 41 and 42 protect the inner bladder during assembly of the handles 31 and during handling of the container 10. Tabs 41 and 42 also act to insulate the hand of a user from the bladder 12, which may be advantageous when the contents are uncomfortably hot or cold. Tabs 41 and 42 can be left free (subject to the constraint provided by the inner bladder) to rotate about edgefolds 50 and 51 within the assembled container, which can give rise to an easier provision of clearance between the handle portions 28 and 29 and tabs; 41 and 42 when fingers of the hand are inserted to grasp the handle 31. This clearance is due to the tabs 41 and 42 pressing inwardly against the inner bladder, displacing the contents slightly.

Alternatively, tabs 41 and 42 can be glued to tabs 45 and 46 respectively, as described above. In the latter case the glued tabs act to protect the inner bladder substantially as before described with reference to tabs 41 and 42 only, except that the glued tabs rotate about edgefolds 71 and 72.

The slotted portion 20 of the outer container 11 is located in a cordier area of a wall 60 of the container. The location of the slotted portion 20 there exploits the portion of the wall 60 adjacent and stiffened by edgefolds 54 and 72. This provides a more secure interlock between the outer container 11 and the spout 14 of the inner liner 12.

Figure 9:
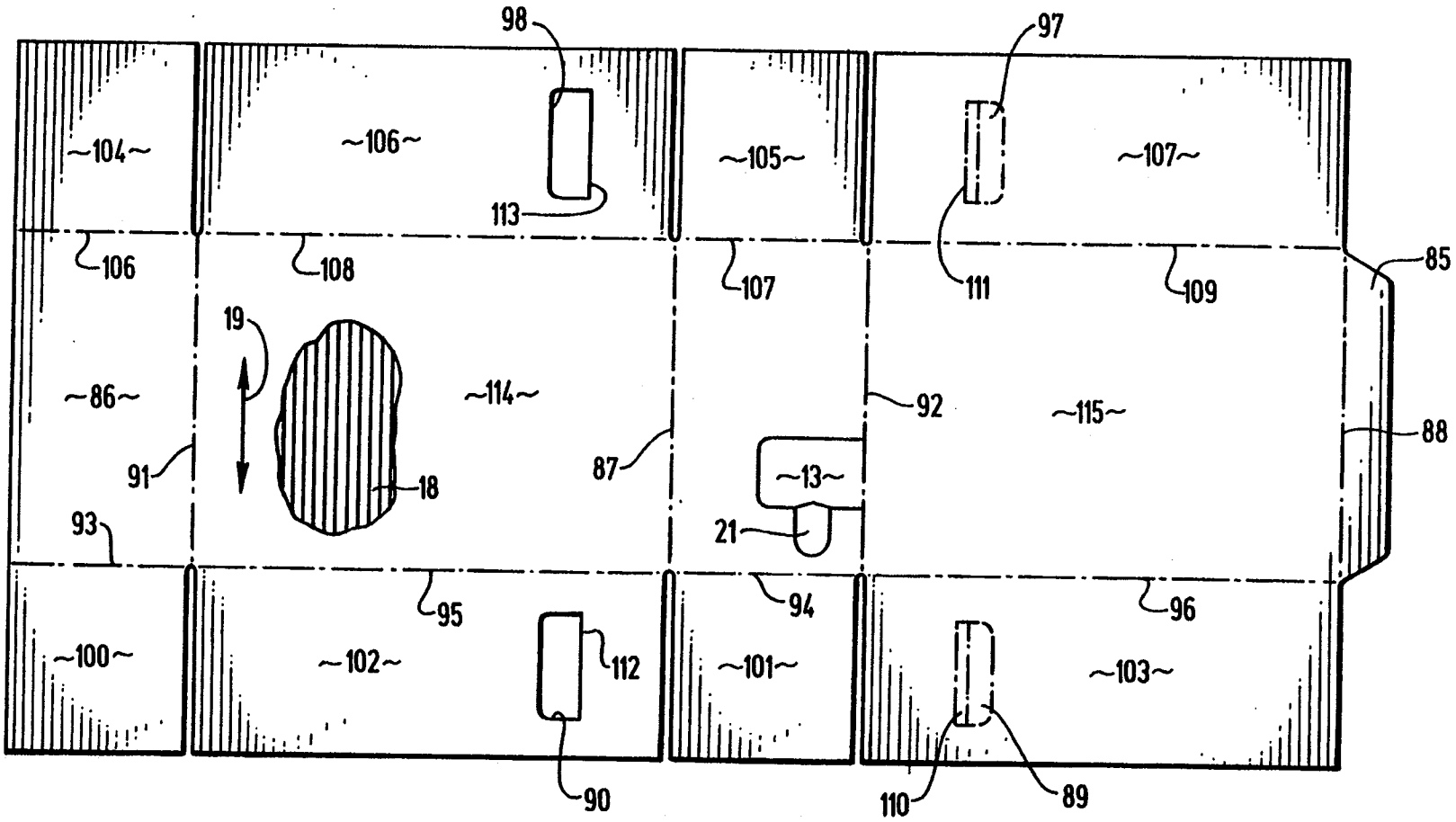
FIG. 9 is a plan view of an outer container according to the invention before folding and assembly.
Figure 10:
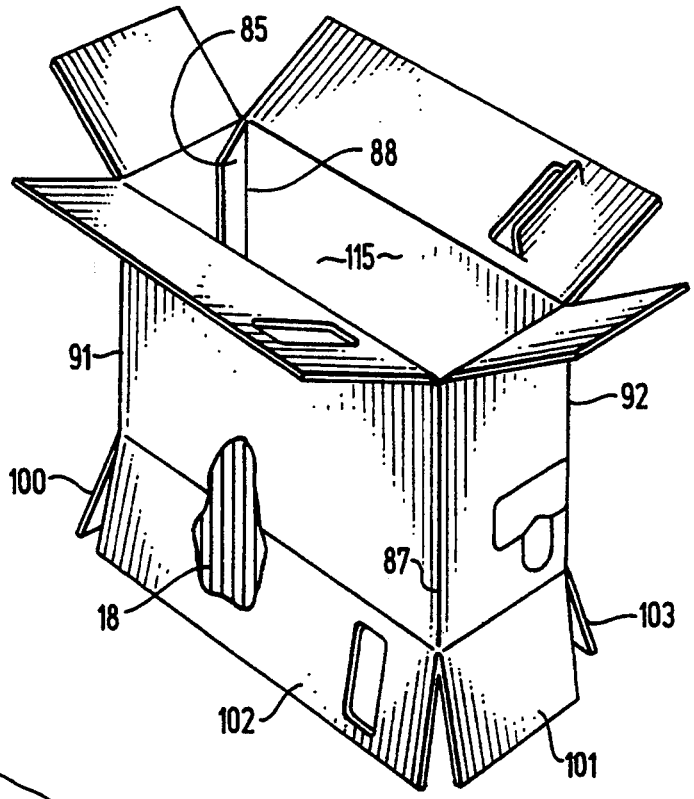
FIG. 10 is a perspective view of an outer container according to the invention before assembly.
Figure 11:
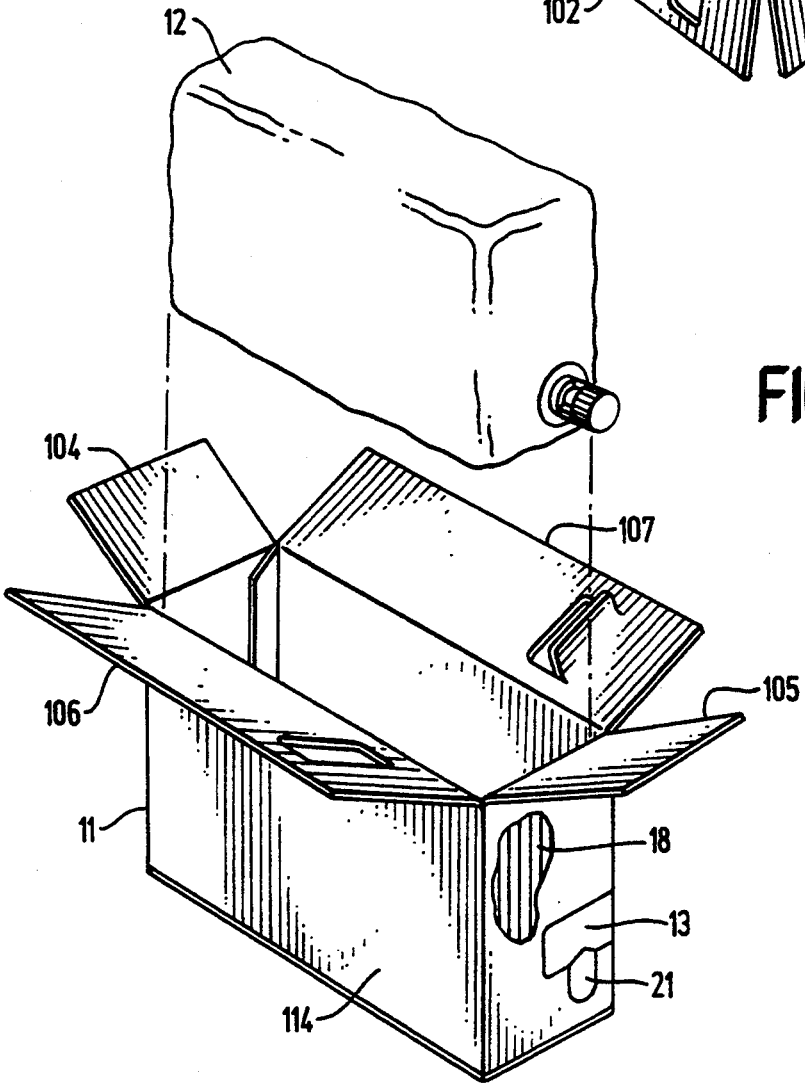
FIG. 11 is an exploded perspective view of a container according to the invention illustrating folding and assembly.

Notwithstanding the above described advantages of the taped closure, should a glued disposable container 10 be desired, it may be provided as exemplified in a second embodiment illustrated in FIGS. 9, 10 and 11. In this embodiment, the features of the locking flap 13 and the interaction of the spout 14 and the slot 20 and locking flap of the outer container 11 are identical to those of the first embodiment described above. Likewise, advantageous use may be made of the properties of corrugated cardboard as before described.

However, in this embodiment the outer container 11 is glued in a conventional manner. Referring to FIG. 9, a tab 85 is provided which is glued to a wall portion 86 at the opposite side of a precut and prescored outer container 11. This is done in a conventional manner by flexing edgefolds 87 and 88 to bring tab 85 and wall portion 86 into contact. After gluing tab 85 to wall 86 the outer container 11 can be left folded flat for storage or transport.

The outer container has die-cut and double scored handle portions 89 and 97, and handle cut-outs 90 and 98 for forming handles 31 as described below. A locking flap 13 and a slot tab 21 are provided as in the first embodiment. The locking flap and slot tab have the same orientation as compared with the corrugations 18 of the cardboard as described in connection with the first embodiment. The lay-out of the outer container 11 is otherwise conventional.

Referring to FIGS. 10 and 11 in addition to FIG. 9, the disposable container 10 of this second embodiment is assembled by opening the glued and folded flat outer container 11 into a box tube as shown in FIG. 10 by flexing edgefolds 87, 88, 91 and 92. Tabs 100 and 101 are then folded in about edgefolds 93 and 94 respectively, followed by folding in inner side wall 102 about edgefold 95. Outer side wall 103 is then folded in about edgefold 96 and glued to inner side wall 102. Inner bladder 12 is then placed within the outer container 11, as in the first embodiment, with a spout 14 positioned adjacent locking flap 13 as in the first embodiment.

The outer container is then closed by folding in tabs 104 and 105 about edgefolds 106 and 107, then folding inner side wall 106 in about edgefold 108. Outer side wall 107 is then folded about edgefold 109 and glued to inner sidewall 106.

At a convenient time thereafter, the handle portions 89 and 97 on each side can be folded inward about the double score lines 110 and 111, respectively, associated with the handle portions on outer walls 103 and 107 respectively. These handle portions are wrapped about handle edges 112 and 113 of inner side walls 102 and 106 respectively. The double score lines 110 and 111 allow for the thickness of the cardboard of the inner wall members. During this process, and in handling the container, the tabs 101 and 105 are positioned behind the handle portions 89 and 97 on each side of the assembled container, between each handle portion and the inner bladder 12. The tabs are not glued, and thus are free to press inward against the bladder 12, displacing the bladder somewhat. This provides a clearance to insert the handle portions in assembly, and later the fingers of a hand in handling the container. Tabs 101 and 105 thus protect the inner bladder, and may also insulate a users hand somewhat from the bladder which may be advantageous in handling refrigerated materials for example as before described.

Thus in both embodiments the container 10 is conveniently handled due to the provision of cut-out handles 31 in walls of the container. In dispensing the contents of the container, it may be convenient to orient the container resting on side wall 103 as shown in FIG. 11, alternative to resting on wall 40 as shown in FIG. 1 as a handle 31 can advantageously be used to tip the container when the contents are nearly depleted. The screw-on spigot 30 can be oriented as appropriate to either configuration.

Also, as an alternative to recycling the outer container 11 of the present invention, the container may be sized to conveniently store other items. For example, the containers could be configured so that records, books and other items could be stored in reassembled used outer containers.

From the foregoing, it will be appreciated that the disposable container for pourable materials 10 of the present invention provides an improvement over previously known containers of this type by providing a more reliable interlocking of the spout 14 of the bladder 12 and the outer container 11 by incorporating a slot 20 and locking flap which cooperate as described to hold the spout in place. The properties of corrugated cardboard, which is often used to form containers of this type, are thus exploited to advantage in this interlock. Additionally, the disposable container 10 according to principles of the present invention is convenient to break down and recycle due to closure of the outer container 11 by a single length of adhesive tape 17, which is relatively easy to remove. The outer container box 11 folds flat for recycling or disposal after removal of the adhesive tape 17.

While particular forms of the invention have been described, it will be apparent that various modifications can be made without departing from the spirit and scope of the invention.

What is claimed is:

1. A container for pourable materials, comprising:

an outer container;

an inner fluid-tight bladder having a resealable dispensing opening therein and an interlocking portion adjacent the resealable dispensing opening;

a slotted portion of said outer container defining a slotted opening, having an elongated direction, for receiving the interlocking portion of said inner liner;

a locking flap portion of said outer container defining a single hinged flap and corresponding second opening, said second opening interconnecting with said slotted opening, said flap rotating about an axis parallel to the elongated direction of the slotted opening of said slotted portion, wherein the interlocking portion of said inner bladder is inserted into said slotted portion of said outer container and afterward said locking flap portion is closed to interlock said inner bladder and said outer container whereby movement of the interlocking portion within said slotted portion towards said locking flap is restricted to a direction wherein said interlocking portion applies force to said locking flap in a direction parallel to the axis of rotation of said locking flap.

2. The container of claim 1, wherein the outer container is formed of corrugated cardboard having a first relatively rigid direction of bending parallel to the corrugations of the card board and a second relatively flexible bending direction perpendicular to the first direction, and wherein the first bending direction is parallel to the elongated direction of said slotted portion and the flap of said locking flap portion rotates in the second bending direction.

3. The container of claim 1, wherein said slotted portion is located in an area of a wall surface of said outer container adjacent a folded edge of said outer container which is stiffened by the adjacent wall sharing an edge-fold of said outer container.

4. The container of claim 3, wherein the hinge portion of the locking flap of said locking flap portion is coextensive with the edge-fold of said outer container.

5. The container of claim 1, wherein the outer container is folded so as to enable the container to be securely closed after folding to enclose the bladder soley by fixing two flaps together on a single wall surface of the folded outer container by applying of one length of adhesive tape to a common edge between the two flaps.

6. A disposable container for pourable materials, comprising:

an outer container formed of corrugated cardboard having wall portions interconnected by edge folds, the cardboard having a first direction parallel to the corrugations in the cardboard, and a second direction perpendicular to the corrugations in said cardboard;

an inner fluid-tight bladder having a resealable dispensing opening therein and an interlocking portion adjacent the opening;

a slotted portion of said outer container defining a slotted opening therein having an elongated dimension corresponding to the first direction of the cardboard forming said outer container, the interlocking portion of said inner liner being inserted into said slotted portion in the first direction to interlock with said outer containment;

a locking flap portion of said outer container defining a hinged flap and an opening in said outer container, which opening interconnects with said slotted opening, said flap rotating about a hinge axis parallel to the first or relatively rigid direction of the cardboard of said outer container, thereby bending in the second or relatively flexible direction, said locking flap portion operable to access the interlocking portion of the resealable dispensing opening of said inner bladder and insert the interlocking portion into said slotted portion, said locking flap portion being closable to retain said interlocking portion within said slotted portion/-whereby force applied to the locking flap by said interlocking portion will applied in the first or relatively rigid direction of the corrugated cardboard of the outer container.

7. The disposable container of claim 6, wherein said slotted portion of said outer container is located adjacent a corner of said outer container thereby being located in area of said outer container wall stiffened by at least two edge folds.

8. The disposable container of claim 6, wherein the hinge portion of the locking flap portion of said outer container is coextensive with an edge fold of said outer container.

9. The disposable container of claim 6, wherein said outer container is configured so as to be folded so as to enable the container to be securely closed after folding to enclose the bladder solely by fixing two flaps together on a single wall surface of the folded outer container by applying a single length of adhesive tape to a common edge between the two flaps.

10. The disposable container of claim 6, wherein the resealable dispensing opening comprises a screw-cap closure, further comprising a removable screw-on spigot.

11. The disposable container of claim 6, further comprising a handle grip portion which is embodied in a first wall portion of said outer container, which wraps around a portion of a second wall portion of said outer container, through a handle cut-out portion in said second wall portion of said outer container.

12. The disposable container of claim 6, further comprising a handle grip portion embodied in said outer container comprising a handle portion in an outer wall portion of said outer container, and a cut-out portion of an inner wall portion of said outer container, where the cut-out portion is adjacent the handle portion and sized to receive the handle portion within the cut-out portion so as to present a flat surface within the outer container in the proximity of the handle grip portion when the handle portion is folded inwardly and around to contact the outer container on an inner surface thereof in an assembled outer container.

13. The disposable container of claim 6, wherein said locking flap portion embodies a cut-out portion positioned adjacent said slotted portion, said cut-out portion adapted to partially receive the interlocking portion of said inner liner.

14. The disposable container of claim 13, wherein said slotted portion of said outer container is dimensioned in the elongated direction such that the interlocking portion of said inner bladder is received in said slotted portion to such a depth that the annular flanges of said interlocking portion clear the flap of said locking flap portion as the flap is rotated about the hinged end of the flap, the interlocking portion being moveable thereafter toward the locking flap and being received within said cut out portion of the flap engages the flap between said annular flanges to hold the flap of said outer container in a closed position.

15. The disposable container of claim 6 wherein said outer container is sized to convenient store records after said inner bladder has been removed.

16. A disposable container for pourable materials comprising:

a. an outer container formed of corrugated cardboard having a first direction parallel to corrugations in the cardboard corresponding to a first bending direction, and a second direction corresponding to direction perpendicular to the first direction, and which is configured to be folded into a box and retained in folded position by a single length of adhesive tape;

b. an inner fluid-tight bladder having a resealable dispensing opening which incorporates an interlocking portion having two annular flanges, which interlocks with said outer container;

c. a slotted portion of said outer container defining a slot configured to interlock with the interlocking portion of said bladder wherein the interlocking portion of said bladder is inserted into said slot in a direction parallel to the first direction of said outer container;

d. a locking flap portion of said outer container defining an opening in said outer container adjacent and interconnected with said slot portion of said outer container having a cut-out portion for receiving the interlocking portion of said inner fluid-tight bladder, and a hinged edge parallel to the first direction, and which opens in the second direction about said hinged edge so that the interlocking portion of said inner bladder may be inserted into said slot and said locking flap portion may be re-closed to retain said interlocking portion into said slotted portion, the locking flap being retained between the two annular flanges of said inner liner and thereby held in closed position when afterward the interlocking portion of said inner liner is moved back against the flap of said locking flap portion.

17. A container for pourable materials, comprising:

an outer container having a multiplicity of wall surfaces joined by edge folds;

an inner fluid-tight bladder having a resealable dispensing opening therein and an interlocking portion adjacent the resealable dispensing opening;

a slotted portion of said outer container defining a slotted opening, having an elongated direction, for receiving the interlocking portion of said inner liner, located in an area of a wall surface of said outer container adjacent a folded edge of said outer container which is stiffened by the adjacent wall sharing an edge-fold of said outer container; and a locking flap portion of said outer container defining a single hinged flap and corresponding second opening, said second opening interconnecting with said slotted opening, the hinge portion of the locking flap being coextensive with an edge-fold of said outer container, said flap rotating about an axis parallel to the elongated direction of the slotted opening of said slotted portion; wherein the interlocking portion of said inner bladder is inserted into said slotted portion of said outer container and afterward said locking flap portion is closed to interlock said inner bladder and said outer container.

18. The container of claim 17, wherein the outer container is formed of corrugated cardboard having a first relatively rigid direction of bending parallel to the corrugations of the card board and a second relatively flexible bending direction perpendicular to the first direction, and wherein the first bending direction is parallel to the elongated direction of said slotted portion and the flap of said locking flap portion rotates in the second bending direction.

19. A disposable container for pourable materials, comprising:

an outer container formed of corrugated cardboard, the cardboard having a first direction parallel to the corrugations in the cardboard, and a second direction perpendicular to the corrugations in said cardboard;

an inner fluid-tight bladder having a resealable dispensing opening therein and an interlocking portion adjacent the opening;

a slotted portion of said outer container defining a slotted opening therein having an elongated dimension corresponding to the first direction of the cardboard forming said outer container, the interlocking portion of said inner liner being inserted into said slotted portion in the first direction to interlock with said outer containment;

a locking flap portion of said outer container defining a hinged flap and an opening in said outer container, which opening interconnects with said slotted opening, the hinge of the locking flap of said outer container being coextensive with an edge fold of said outer container, and said flap rotating about a hinge axis parallel to the first or relatively rigid direction of the cardboard of said outer container, thereby bending in the second or relatively flexible direction, said locking flap portion operable to access the interlocking portion of the resealable dispensing opening of said inner bladder and insert the interlocking portion into said slotted portion, said locking flap portion being closable to retain said interlocking portion within said slotted portion.

20. The disposable container of claim 19, wherein said slotted portion of said outer container is located adjacent a corner of said outer container thereby being located in area of said outer container wall stiffened by at least two edge folds.

21. The disposable container of claim 19, wherein the interlocking portion of said inner liner comprises a pair of annular flanges protruding perpendicular to a cylindrical spout integral with the resealable dispensing opening of said inner bladder which are spaced apart to receive the thickness of said outer container therebetween.

22. The disposable container of claim 21, wherein said locking flap portion embodies a cut-out portion positioned adjacent said slotted portion, said cut out portion adapted to partially receive the interlocking portion of said inner liner.

23. The disposable container of claim 22, wherein said slotted portion of said outer container is dimensioned in the elongated direction such that the interlocking portion of said inner bladder is received in said slotted portion to such a depth that the annular flanges of said interlocking portion clear the flap of said locking flap portion as the flap is rotated about the hinged end of the flap, the interlocking portion being moveable thereafter toward the locking flap and being received within said cut out portion of the flap engages the flap between said annular flanges to hold the flap of said outer container in a closed position.

* * * * *

UNITED STATES PATENT AND TRADEMARK OFFICE

CERTIFICATE OF CORRECTION

PATENT NO. : 5,377,876

DATED : January 3, 1995

INVENTOR(S) : Ronald Smernoff

It is certified that error appears in the above-indentified patent and that said Letters Patent is hereby corrected as shown below:

Column 1, line 39, change "means can De used" to --means can be used--.

Column 3, line 68, change "purposes; of illustration" to --purposes of illustration--.

Column 5, line 49, change "handle cut outs" to --handle cut-outs--.

Column 6, line 48, change "and 29 and tabs; 41" to --and 29 and tabs 41--.

Column 6, line 59, change "in a cordier area" to --in a corner area--.

Column 9, line 44, change "slotted portion/-" to --slotted portion;--.

Column 10, line 37, change "convenient store records" to --conveniently store records--.

Signed and Sealed this

Nineteenth Day of September, 1995

*Attest:*

*Attesting Officer*

Bruce Lehman

BRUCE LEHMAN

*Commissioner of Patents and Trademarks*